United States Patent [19]

Bagne

[11] 4,155,531

[45] May 22, 1979

[54] HANGER FOR PLASTIC PACKAGING

[75] Inventor: Gordon Bagne, Santa Ana, Calif.

[73] Assignee: Plasticolor Molded Products, Inc., Placentia, Calif.

[21] Appl. No.: 878,752

[22] Filed: Feb. 17, 1978

[51] Int. Cl.[2] ..... A44B 17/00; B42F 13/00

[52] U.S. Cl. ..... 248/360; 223/95; 248/340

[58] Field of Search ..... 248/300, 308, 304, 301, 248/359, 360, 339, 318, 340; 24/230.5 R, 84 C; 223/87, 95; 160/330; 16/87.2

[56] References Cited

U.S. PATENT DOCUMENTS

| | | | |
|---|---|---|---|
| 3,302,917 | 2/1967 | Winkler | 248/359 |
| 3,310,272 | 3/1967 | Brunger | 248/215 X |
| 3,727,869 | 4/1973 | Flubacker | 248/339 |
| 4,073,457 | 2/1978 | Batts | 223/95 X |

FOREIGN PATENT DOCUMENTS

| | | | |
|---|---|---|---|
| 262560 | 5/1964 | Netherlands | 248/360 |

*Primary Examiner*—J. Franklin Foss

*Attorney, Agent, or Firm*—Jackson, Jones and Price

[57] ABSTRACT

A plastic hook mechanism which inserts into a piece of cardboard secured to an item of merchandise is disclosed. The cardboard is secured to the merchandise by wrapping both the cardboard and the merchandise in a clear plastic which is subsequently heat treated to shrink it. Thereafter, the plastic hook is inserted through the sealed plastic and into a hole in a crease formed by a folded-over flap at one end of the cardboard. The hook is collapsible so as to fit through the hole even though the hole is far smaller than the hook's shoulderlike support members. After insertion, the hook's shoulders resume their uncollapsed shape and support the cardboard piece, while the hook protrudes through the small hole to allow the plastic wrapped merchandise to be hung on a display rack.

8 Claims, 4 Drawing Figures

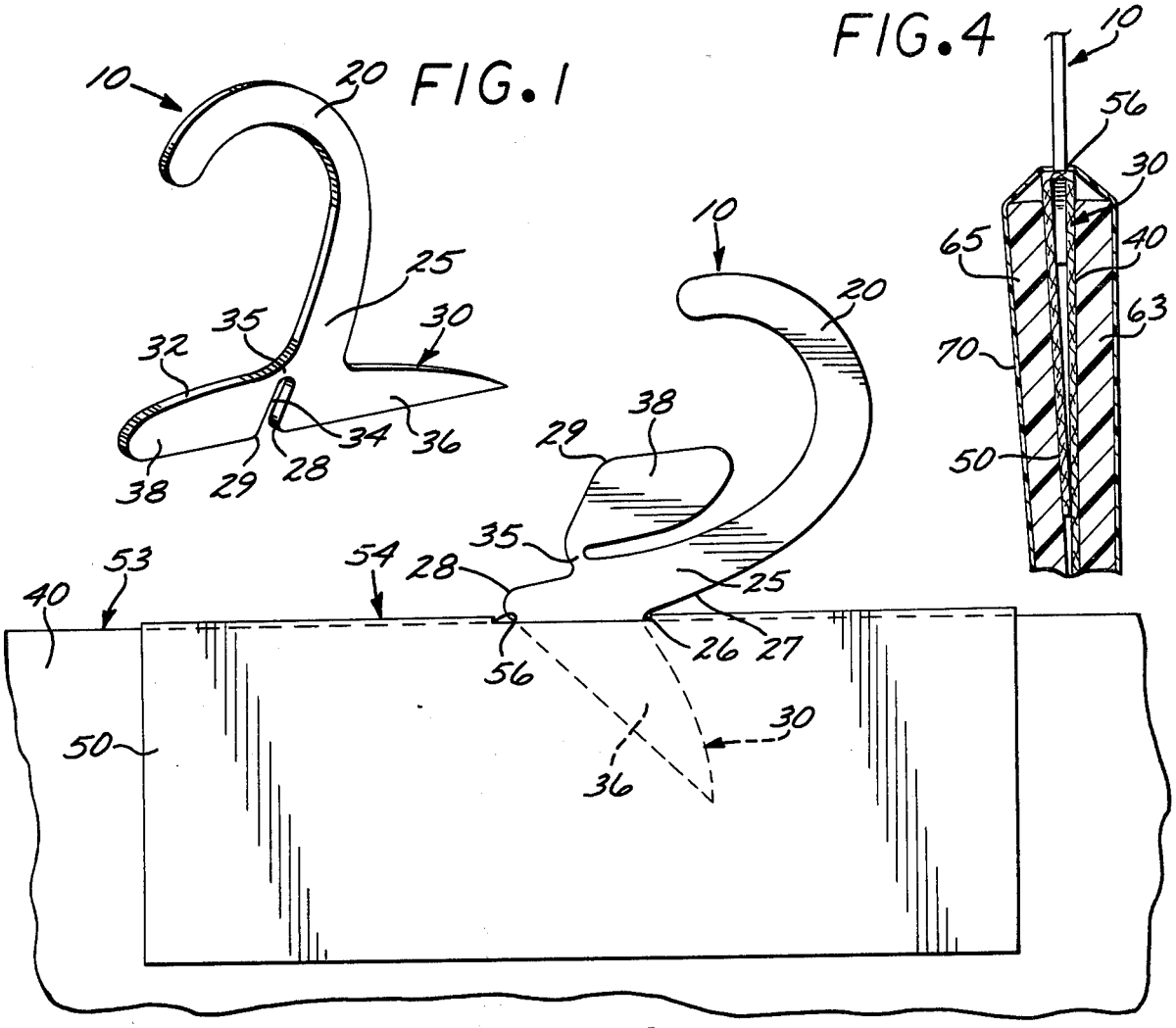
FIG. 1
FIG. 4
10
20
25
30
32
35
34
36
38
29
28
40
53
54
56
26
27
50
65
63
70
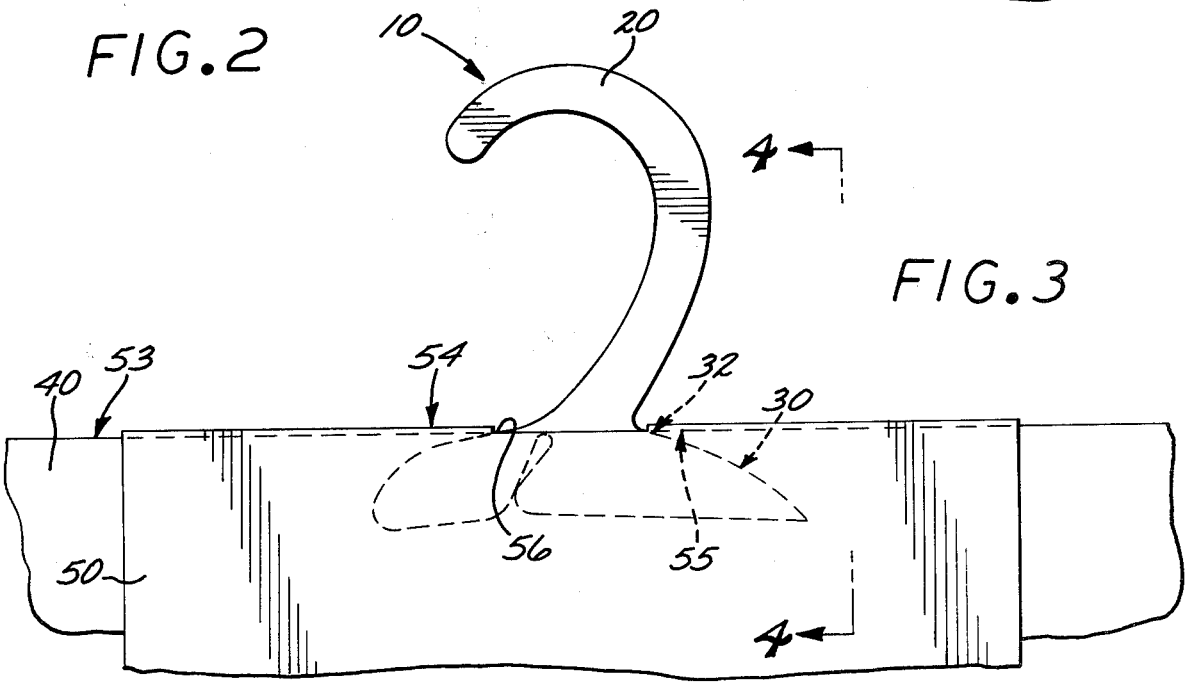
FIG. 2
FIG. 3
10
20
4
40
53
54
32
30
56
55
50

HANGER FOR PLASTIC PACKAGING

BACKGROUND OF THE INVENTION

1. Field of the Invention

The invention relates to merchandise packaging and more particularly to hangers to hang merchandise on display racks.

2. Description of the Prior Art

Hangers are well known devices. They have ranged from the simple clothes hangers to more complex devices used in conjunction with the commercial packaging of merchandise to be hung on display racks. Of particular interest are hangers used to hang packages, such as rubber car mats and carpets.

A prior hanger used to hang car mats and carpets is known as Auto MATique II and is manufactured by Rubbermaid® Specialty Products, Inc., La Grange, Ga. A similar hanger is manufactured by Kraco Enterprises, Inc., Compton, Calif. These hangers are made from a piece of cardboard arranged to fit about the top of the car floor mat or carpet. The mat or carpet is fastened to the cardboard by means of staples. The top of the cardboard piece is formed into a hook. This allows the floor mats and carpets to be hung on a display rack.

Some of the drawbacks presented by this type of hanger are that (1) the use of staples damages the merchandise, and (2) the cardboard hanger is generally required to be a multi-fold piece of relatively strong cardboard to be able to support the mats or rugs. The use of staples prevent the car mats and carpets from being wrapped in a clear plastic before being fastened to the cardboard hanger.

OBJECTS AND SUMMARY OF THE INVENTION

Therefore, it is an object of the present invention to provide a simple hanger arrangement to hang merchandise.

It is another object of this invention to provide a simple collapsible hook that can be inserted into an aperture of a package and once inserted expands to its uncollapsed state and is then useable to hang the package for display purposes.

These objects and the general purpose of this invention are accomplished by providing a hook having collapsible shoulders which is inserted into a hole in a package to be displayed. The hook's shoulders are made collapsible by providing a slit running slightly off-center from the bottom of the shoulders to nearly the top. The region between the top of the slit and the top of the shoulders is made of a plastic material that is both flexible and resilient. When the hook is inserted, the shoulders collapse at this flexible point allowing the shoulders to fit into the small hole. After the hook is fully inserted, pulling on it will cause its shoulders to resume their uncollapsed shape. The shoulders cannot be withdrawn from the hole because the slit in the shoulder of the hook only allows the shoulders to collapse in one direction. The hook protrudes out of the hole and allows the entire package to be hung on a display rack.

The package for merchandise such as car rugs and mats is made of a single cardboard support piece which has an extension on one end which is folded over to form a flap. The cardboard support piece and car rug or mat are wrapped in plastic which is heat-shrunk, thereby securing the merchandise to the cardboard. A hole or slit is formed in the plastic over the hole in the fold of the cardboard support piece. The plastic hook is inserted in this hole or slit.

BRIEF DESCRIPTION OF THE DRAWINGS

These and other objects of the present invention will become more readily apparent upon considering the following detailed description of the preferred embodiments when taken in conjunction with the following drawings in which like reference numerals designate like parts throughout the figures thereof and wherein:

FIG. 1 is a plan view of a hook having shoulders;

FIG. 2 is a plan view of the hook with one portion of the shoulders bent back during insertion into a small hole in a cardboard support;

FIG. 3 is a plan view of the fully inserted hook with the bent-back portion of the shoulders having resumed its original position;

FIG. 4 is an edge view of cross-section taken along the length of a complete car mat package.

DESCRIPTION OF THE PREFERRED EMBODIMENT

Referring to FIG. 1, a plan view of the hook 10 is shown. It is comprised of a conventional curved portion 20 connected via a neck 25 to shoulders 30. The curved portion 20 is designed to be placed over a support bar or hook on a display rack. When the curved portion 20 is so engaged, the shoulders 30 will support an article suspended upon them. The shape of the curved portion 20 is conventional and the particular angle of incidence of the neck 35 shown can be chosen for aesthetic appeal subject to the limitations which will become apparent in the discussion below.

The top edge of shoulders 30 is designed to support a cardboard member 40, shown in FIG. 3. The cardboard member 40 is attached to merchandise such as car mats 63, 65 (FIG. 4) to be hung on a display rack by wrapping both the cardboard member and the merchandise in a clear plastic 70 of a type which when heat-treated will uniformly shrink. Thus, the cardboard member 40 and the merchandise will be forced together and friction will hold the cardboard member 40 to the merchandise.

The cardboard member 40 as shown in both FIGS. 2 and 3 has a flap 50 which is bent over to one side of the cardboard member 40 to form a crease 54 along its top 53. The crease 54 has a lateral dimension sufficient to permit entry of the hook 10 into a slot 56 formed therein. When the hook 10 is in place, the top edge 32 of the shoulders 30 abuts against the bottom 55 of the crease 54, and the curved portion 20 protrudes through a small opening or slot 56 in the fold or crease formed by the folded flap 50. When the hook 10 is hung on a display rack (not shown), it will support the cardboard member 40 by the shoulders abutting against the bottom 55 of the fold or crease 54 and the cardboard member 40 will, in turn, support the merchandise (car mats 63, 65) via friction caused by the heat-treated clear plastic wrapping 70. It should be noted that the flap 50 cannot bend away from the cardboard member 40 when wrapped because it would be held in place by the plastic wrapping 70.

It is preferable, when the invention is used in conjunction with car mats or carpets, to include two such mats 63, 65, as shown in FIG. 4, one each for each side of the car, in one package. The cardboard support member 40 is sandwiched between them and the clear plastic 70 is wrapped around the entire package. Upon heat-treating, the plastic will shrink, forcing the two mats to compress against the cardboard support 40.

The hook 10 is constructed so that it can be inserted into the cardboard support 40 after the entire package has been sealed in plastic and heat-treated. This can be done by making a small hole in the plastic just above the hole 56 in the top of the cardboard support member 40 and inserting the hook 10 into the slot 56 as shall hereinafter be more fully described. Due to the construction of the hook 10, this hole in the plastic can be quite small, which will minimize substantially an unsightly large tear in the plastic wrapping, as well as prevent the tear from enlarging, first due to its small size, and secondly due to the method of supporting the merchandise which distributes the hanging stress evenly about the entire package and not just along the top near the hole in the plastic.

By allowing the insertion of the hook 10 after the package has been sealed in the plastic wrapping, the machinery to wrap the merchandise and apply heat-treating can be simpler because the shape of the package will now be substantially rectangular. Moreover, the hook 10 can now be made of light, inexpensive plastic. If the plastic hook were present during the heat-treating process, it would warp, as does all plastic in the presence of sufficient heat.

To allow the hook 10 to be inserted into the cardboard support member 40 after the package has been sealed, the hook 10 is provided with a special hinge 35 at the top of a slit 34 in the shoulders 30 to allow one portion 38 of the shoulders 30 to be bent pivotally backwards toward the curved portion 20. This shortens the effective length of the shoulders 30 upon entry to allow it to be inserted into a smaller hole or slot 56 in the cardboard support 40 (FIG. 2).

As shown in FIG. 2, the hole 56 in the cardboard support 40 needs to be only large enough to allow entry of the hook 10 in the position shown in FIG. 2. In this position, the largest dimension of the hook 10 to be fitted into the hole 56 is the distance between point 26 at the juncture of the neck 25 and shoulders 30 and point 28 at the bottom of the slit 34 on the unbent portion of the shoulders 30.

From the position shown in FIG. 2, the hook 10 would be rocked in a counterclockwise direction to allow entry of the unbent portion 36 of the shoulders 30. Point 28 of the shoulders 30 would submerge below the crease 54 with this motion.

When the neck 25 is substantially perpendicular to the crease 54, it can be forced straight down into the hole 56. This is allowed because the portion 38 of the shoulders 30 will bend backwards, pivoting at the hinge 35 at the top of the slit 34. As the portion 38 of the shoulders 30 pivot toward the curved portion 20, the distance between point 27 on the neck 25 of the hook 10 and point 29 on the bottom of slit 34 on bent portion 38 of the shoulders 30 will decrease.

When points 27 and 29 are the same distance apart as the length of the hole 56, point 29 of portion 38 of the shoulders 30 will enter the hole 56.

The material comprising the hinge 35 is both flexible and resilient. Thus, when the shoulders 30 are fully inserted, the resiliency of the material will cause the bent portion 38 of the shoulders 30 to resume its original shape as shown in FIGS. 1 and 3. When this has occurred, the hook 10 cannot again be withdrawn from the hole 56 because the lateral dimensions of the shoulders 30 are broader than the hole 56 and because the pivotal portion 38 of the shoulders 30 cannot pivot away from the curved portion 20, a counterclockwise direction in FIG. 1. This latter pivot is prevented because point 29 on one side of the slit 34 will abut against point 28 on the other side of the slit 34. This abutment will occur even though the shoulders 30 are relatively thin, because the shoulders 30 are held in co-planar alignment by being compressed between the cardboard support 40 and the flap 50.

This completes a description of the preferred embodiment of the present invention. However, it is to be understood that this description is not meant to limit the scope of the invention to the particular embodiment disclosed. The invention can be practiced in many other applications and embodiments within the scope of the appended claims, in which I claim:

What is claimed is:

1. An apparatus for hanging a packaged article, wherein said package has a slot therein of a predetermined length, said apparatus comprising:
   - a curved section ending in a neck; and
   - a substantially flat body with shoulders defining a top edge that is longer than said slot, said body being attached to said neck near the center of said top edge, said body being truncated by a bottom edge, said body having a slit therein extending from the bottom edge towards the top edge and terminating to one side of the intersection of the shoulders with the neck, forming two shoulder segments, the slit terminating sufficiently near the top edge to permit bending back one shoulder segment for inserting the body into the slot.

2. The apparatus of claim 1 wherein said curved section and neck are substantially flat and co-planar with said shoulders.

3. The apparatus of claim 2 wherein said apparatus is made from a plastic material.

4. The apparatus of claim 2 wherein said apparatus is cut from a single sheet of plastic material.

5. An apparatus for hanging an article for display, comprising:
   - a support member adaptable for attachment to the article to be displayed, said support member having a flap folded along its top side with a slot of a predetermined length in the crease formed by the fold, said slot being substantially at the center of said top side; and
   - a hook defined by a curved section ending in a neck and shoulders having a flat body with a top and bottom edge attached to said neck near the center of said top edge, the shoulders including a slit running from the bottom edge to a region near the top edge, the material between the top of the slit and the top edge of the shoulders being flexible, whereby said hook supports said supporting member of its shoulders with its neck protruding through the slot in the support members.

6. The apparatus of claim 5 wherein said support member is made of cardboard.

7. The apparatus of claim 5 wherein said article to be displayed is substantially flat, said apparatus further comprising:
   - a complete enclosure of heat-shrunk plastic tightly surrounding said support member and the flat article so as to press the article tightly to said support members.

8. An apparatus for hanging a packaged article comprising:

a support member adaptable for attachment to said package, said support member having a a folded flap along its top side with a hole of predetermined length through the crease formed by said fold substantially at the center of said top side; and a hook defined by a curved section ending in a neck in a single plane, and shoulders comprising a flat, long body with a top and a bottom edge attached to said neck near the center of said top edge and aligned with the flat dimension co-planar with the plane of said hook and with said long dimension substantially perpendicular to the angle of incidence of said neck with said top edge, the shoulders including a slit running from the bottom edge to a region near the top edge slightly to one side of the intersection of the shoulders with the neck dividing the shoulders into long and short portions; wherein the material between the top of the slit and the top edge of the shoulders is flexible and resilient, and wherein the distance between the intersection of the neck, on the side of the neck furthest from the slit to said bottom edge at the bottom of said slit is slightly less than the length of the hole through the crease in said support member, said hook supporting said support member by its shoulders with its neck protruding through the hole in the support members.

* * * * *